US005857468A

United States Patent [19]

Camp, Jr. et al.

[11] Patent Number: 5,857,468

[45] **Date of Patent: *Jan. 12, 1999**

[54] HAIR FORMING DEVICE

[75] Inventors: Charles L. Camp, Jr.; John W. Lindley, Jr., both of Clyde, N.Y.

[73] Assignee: Hair Hoops Inc, Rochester, N.Y.

[ * ] Notice: The term of this patent shall not extend beyond the expiration date of Pat. No. 5,555,901.

[21] Appl. No.: 668,529

[22] Filed: Jun. 20, 1996

Related U.S. Application Data

[63] Continuation of Ser. No. 434,850, May 4, 1995, Pat. No. 5,555,901.

[51] Int. Cl.[6] ..... A45D 8/04

[52] U.S. Cl. ..... 132/273; 132/274

[58] Field of Search ..... 132/273, 274, 132/200, 275, 278, 212, 276; 446/48, 487; 273/155, 153.5; 59/80, 78, 83, 84; 63/4, 20; D11/17, 15

[56] References Cited

U.S. PATENT DOCUMENTS

| | | | |
|---|---|---|---|
| D. 220,019 | 2/1971 | Solomon . | |
| 1,959,469 | 5/1934 | Gregory | 446/487 |
| 2,669,239 | 2/1954 | Smith . | |
| 2,972,833 | 2/1961 | Grutta | 59/80 |
| 3,626,955 | 12/1971 | Greenwood . | |
| 3,775,897 | 12/1973 | Soulakis et al. | 446/487 |
| 4,369,690 | 1/1983 | Sapkus . | |
| 5,100,356 | 3/1992 | Atwell | 446/48 |
| 5,156,023 | 10/1992 | Bevolo | 63/20 |
| 5,271,421 | 12/1993 | Videtzky . | |
| 5,379,782 | 1/1995 | Tabb . | |
| 5,398,705 | 3/1995 | Hiltbrand et al. . | |
| 5,441,061 | 8/1995 | Jordan et al. . | |
| 5,497,785 | 3/1996 | Hibbard . | |
| 5,497,795 | 3/1996 | Hibbard | 132/200 |
| 5,590,668 | 1/1997 | Macy | 132/200 |

*Primary Examiner*—Gene Mancene
*Assistant Examiner*—Pedro Philogene
*Attorney, Agent, or Firm*—M. Lukacher; K. Lukacher

[57] ABSTRACT

A hair forming device for arranging a pony tail or braid. The device comprises a series of rings each attached to an adjacent ring in end to end fashion. Adjacent rings overlap just enough to enable a connecting pin formed in one ring to pass through a hole formed in the adjacent ring, and thus connect the two rings. Any two adjacent rings may therefore be arranged to describe a figure eight. Hair is preferably divided into two braids, each braid being passed through each ring. The novel device secures the braids in this manner, and is worn as long as the hair style thus achieved is maintained. Preferably, the connecting pins are arranged parallel to the central axis of the circle described by each ring. In alternative embodiments, the pins permanently connect adjacent rings, or may removably connect adjacent rings, for example by snap fit. In a further alternative embodiment, the device is extended by adding rings and attaching the succession of rings in head to tail fashion, thus forming a closed loop. Two parallel paths are thus established, for passing two or four braids through two rows of rings in parallel. In a still further embodiment, each ring attaches to four neighboring rings, a matrix of rings thus being formed.

4 Claims, 4 Drawing Sheets

HAIR FORMING DEVICE

This is a continuation, of application Ser. No. 08/434,850 filed May 4, 1995 U.S. Pat. No. 5,555,901.

BACKGROUND OF THE INVENTION

1. Field of the Invention

The present invention relates to an accessory for forming a decorative braid in long hair. The device provides a form or guide for constraining the braid to produce a specified configuration.

2. Description of the Prior Art

Adornment of a person's hair, and particularly adornment by tying long hair into braids and like configurations, has long been practiced. In an effort to create new styling effects, it has further been desired to provide hair shaping and controlling devices for influencing the final style or configuration of long hair and braids.

An example is seen in U.S. Pat. No. 5,318,054, issued to Kris Neilson et al. on Jun. 7, 1994. The apparatus shown therein comprises a coiled spring which forms a generally circular band. The spring has internal teeth for engaging the hair, and is held in place by the action of the spring. The coil surrounds a braid at one point along the length of the braid, and when in place, gives the visual impression of a solid, circular band. This device has a singular component, unlike the multiple circular bands of the present invention, and furthermore comprises a self-closing, openable loop. The loops of the present invention are permanently closed.

Another type of device is shown in U.S. Pat. No. 5,167,245, issued to Debra S. Harriett on Dec. 1, 1992. Harriet's device comprises an elongated, flexible member which is spiralled around a braid of hair, and suitably tied to itself. The device is employed in a conjunction with a needle having an eye. The associated method of use disclosed results in a single braid of hair which is encircled at various points along its length by the one flexible member.

U.S. Pat. No. 5,293,884, issued to R. David Chapman et al. on Mar. 15, 1994, describes a hair tie which encircles a braid one time along a limited length of the braid. The apparatus includes a generally rectangular patch of flexible material, which encircles the braid and is fastened in this position. The invention of Chapman et al. encircles the hair at a single point along the pony tail or braid.

U.S. Pat. No. 5,289,834, issued to Lloyd D. Lawrence on Mar. 1, 1994, describes a flexible, elongated device for encircling a pony tail, and enabling the user of the device to manipulate the pony tail into a new configuration. The specified configuration is usually difficult for a person to achieve on his or her own hair, and the device makes this awkward task easier. Lawrence's device is removed from the pony tail or braid after the desired configuration is achieved. This configuration achieves an effect of passing the braid through itself. Hair does not pass through plural surrounding or retaining members.

It will be noted that the devices of Harriett, Chapman et al., and Lawrence all share the common characteristic the principal component surrounding the braid is flexible, which is not the case in the present invention.

None of the above inventions and patents, taken either singly or in combination, is seen to describe the instant invention as claimed.

SUMMARY OF THE INVENTION

The present invention comprises a connected series of circular rings, for passing a wearer's hair through and for maintaining the same in a specially styled configuration. The hair may be divided into any number of braids, each of which is passed through the individual rings of the hair styling device. This device is worn in the hair as long as the style is maintained, and is not removed. Thus, the device is a cosmetic hair accessory as well as an aid in maintaining hair in a desired configuration.

Individual rings overlap only to the extent that a pin oriented along the axis of the circle of its associated ring member can intersect an adjacent ring member. Two adjacent ring members are thus connected, and will lie in parallel planes. Considered another way, two adjacent ring members form a figure eight. The assembly comprises, preferably, three or more rings similarly joined.

A new styling effect is achieved, unlike the device of Harriett, and unlike the effect achieved by employing a number of unconnected rings which would be substantially axially aligned. The novel arrangement of rings alternately divides and combines two braids as they successively penetrate the series of rings. Thus, instead of maintaining the braid in a generally straight and cylindrical configuration, the rings connected in the novel arrangement promote a more dynamic visual effect.

A significant advantage of employing permanently closed rings is that once passed through a ring, a hair braid is then supported thereby. The wearer can concentrate on passing hair through the next ring, and need not devote effort to maintaining the hair in place. This situation is a potential deficiency of the device of Harriett, in that a spirally wrapped hair braid is not secured until the last spiral is completed, and the device is tied.

In an alternative embodiment, connection between adjacent rings is made not only serially, but at other positions also, thereby creating a matrix. The matrix embodiment shares the characteristic that rings are still located in parallel planes, so that braids continue to undergo periodic divisions. In a matrix, however, more than two parallel braids are accommodated.

Accordingly, it is a principal object of the invention to provide a hair braid forming apparatus which has serially connected rings.

A second object of the invention is to provide a form for passing two hair braids through the form, alternately separating and combining the braids as they repeatedly pass through the form.

It is another object of the invention to have a matrix of connected rings.

It is a further object of the invention to orient the rings in parallel planes.

Still another object of the invention is to provide, selectively, a permanently joined assembly of rings, and an assembly of rings which may be manually added to and reduced in number.

An additional object of the invention is to provide the assembly of rings in an arrangement which enables two parallel paths for braids to be present.

It is again an object of the invention to maintain the braid in place merely by passing it through a ring, rather than by tying or otherwise securing the braid in place.

Yet another object of the invention is to provide a cosmetic hair accessory which also assists in forming or styling the hair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
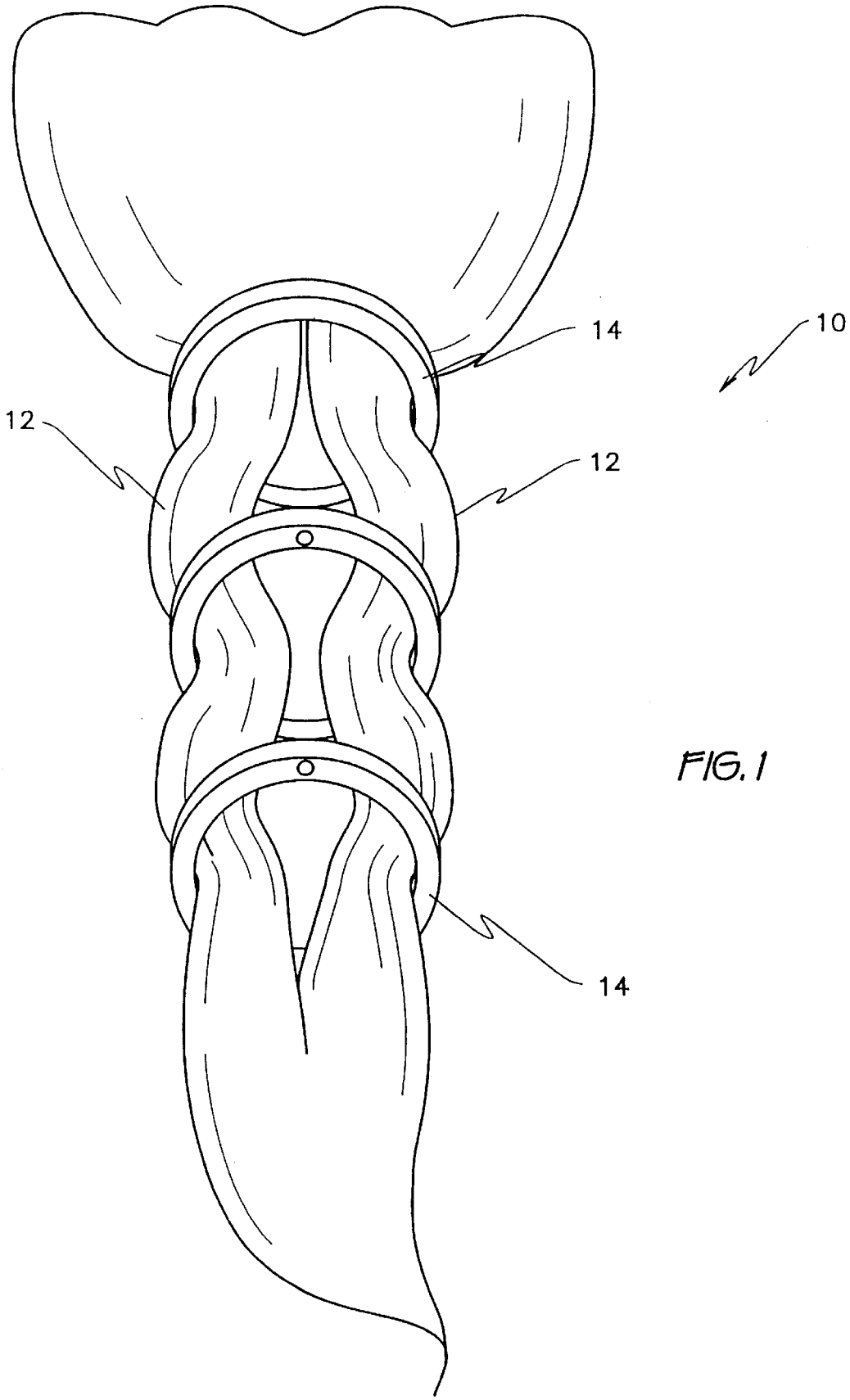
FIG. 1 is an environmental, top plan view of the invention.

The novel hair forming device 10 is shown in FIG. 1 as it is worn by a person having with hair braids 12. Device 10 comprises a series of individual rings 14 connected at opposing ends.

Figure 2:
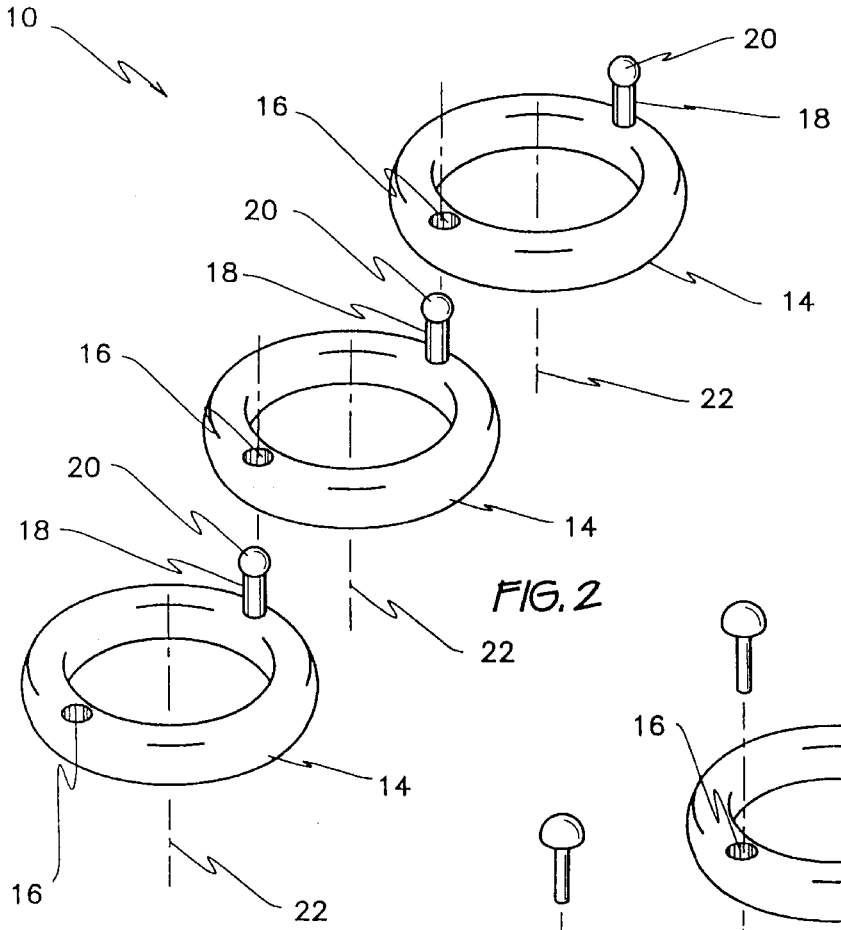
FIG. 2 is an exploded, perspective view of the invention, wherein adjacent rings are connected by a pin and cooperating hole.

FIG. 2 shows the construction of device 10. Each ring 14 has a hole 16 formed entirely therethrough. A linking member 18 is attached to one ring 14, and engages hole 16 of an adjacent ring 14 at a point generally opposite hole 16 of the first ring 14. In this embodiment, linking member 18 comprises a pin formed integrally with its associated ring 14, the pin having an enlarged head 20. The pin is inserted through hole 16, and head 20 resiliently deforms to allow passage. Once through hole 16, head 20 resiliently expands and avoids reentering hole 16 by interference fit. The two adjacent rings 14 so connected thus form a figure eight. It will be appreciated that normally, rings 14 are now mutually connected, but may be manually separated. This will accommodate rearrangement of rings 14 to alter a color style, to add rings 14 to the assembly, and to reduce the number of rings 14 forming the final assembly.

It will be seen in FIG. 2 that linking member 18 comprises a pin having a shaft 20 of constant diameter, and an enlarged head 22 of diameter greater than that of shaft 20. Once passed through hole 16, linking member 18 entraps associated ring 14 by interference fit. As clearly seen in FIG. 1, one ring 14 is now located abutting the other ring 14, in overlying relationship. This abutting, overlying contact will hence also be called tangential contact or relationship herein.

Figure 3:
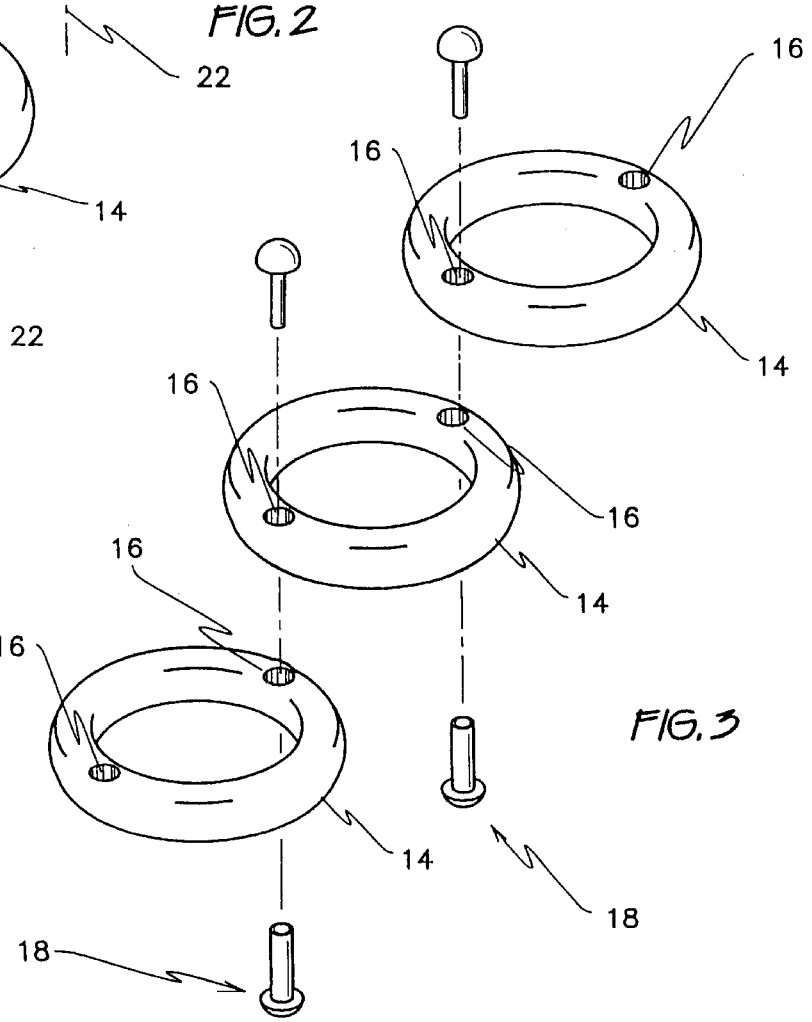
FIG. 3 is an exploded, perspective view of a second embodiment of the invention, employing a rivet to connect adjacent rings.

In a second embodiment, illustrated in FIG. 3, linking member 18 is a double headed rivet which passes through holes 16 formed in adjacent rings 14. In this embodiment, rings 14 are permanently joined. In this embodiment, each ring 14 has two holes 16.

The different forms of linking member 18 allow for a variety of fabrication and assembly techniques. The embodiment of FIG. 2 requires only one type of component, which may be attached and removed from a neighboring component in a modular fashion. This embodiment could be fabricated, for example, from a synthetic resin by injection molding.

It will also be appreciated that other methods of detachable connection are possible. Corresponding patches of hook and loop material (not shown) may be employed, if desired. Also, it would be possible that holes formed in rings for receiving pins not penetrate the ring entirely, and that the enlarged head of the pin be received in this hole in the manner of a ball and socket joint. A fastener such as a screw could be employed, or a semi-permanent fastener, such as a friction pin (neither screw nor friction pin shown) could be employed.

The embodiment of FIG. 3 may also avail itself of injection molding, but a less complicated construction of ring, is required. This may be desirable where a material less susceptible to injection is employed, such as natural or stained wood, leather, or carved stone.

Preferably, the linking member 18, regardless of its embodiment, is oriented parallel to the central axis 22 of each ring 14 (shown in FIG. 2, but equally applicable in other embodiments of ring 14). While this is not absolutely essential, it assures that all rings 14 are arranged to occupy parallel planes, each plane being normal to axis 22 of its associated ring 14, and passing through the round or hair retaining portion of ring 14. Thus, a braid passed through plural rings 14 will repeat a constant pattern of formed curves or bends.

Figure 4:
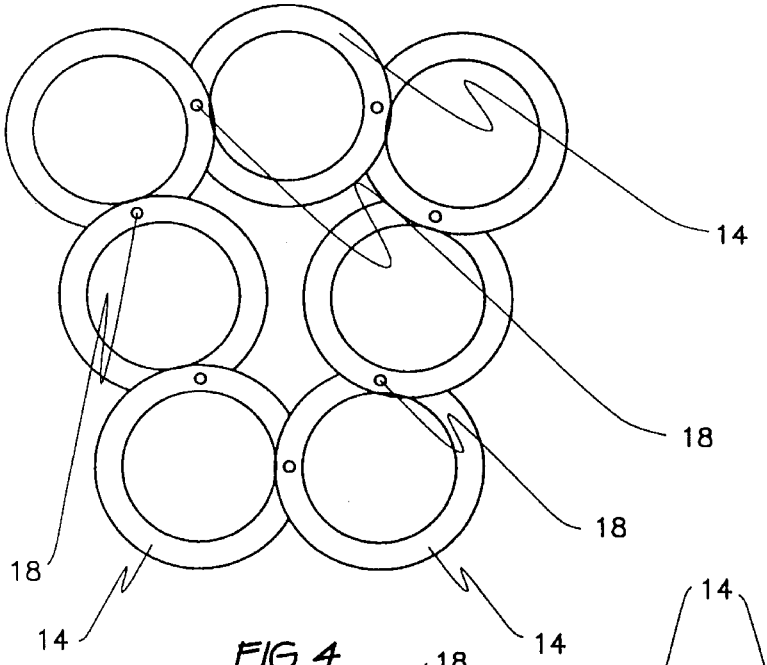
FIG. 4 is a top plan view of a series of six rings arranged as a closed loop.

Device 10 thus connects adjacent rings 14 end to end. It is also possible to join a series of rings 14 so formed in a closed loop, as illustrated in FIG. 4. The advantage of this arrangement is to establish two parallel series of rings 14, so that two braids of hair may be arranged in parallel.

Figure 5:
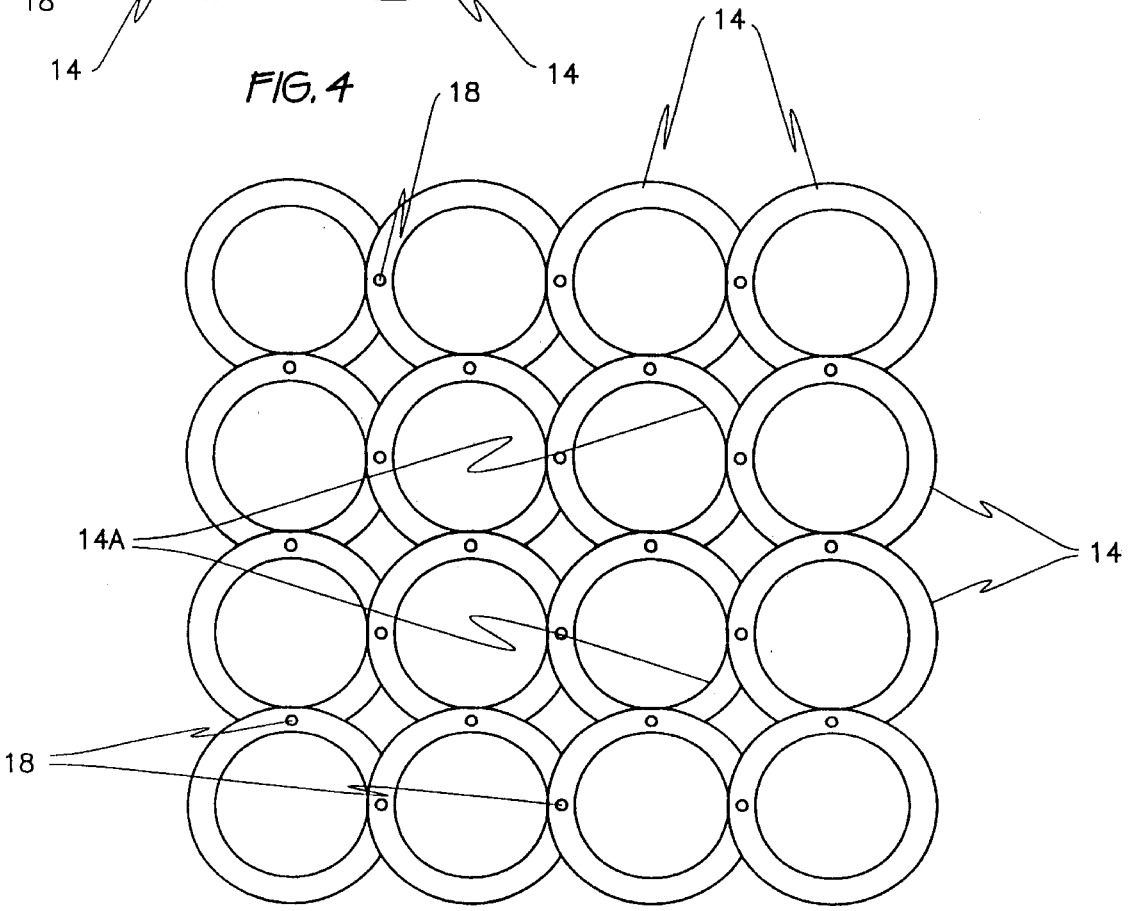
FIG. 5 is a top plan view of a matrix of rings formed by joining at four equally spaced points of each ring.

Referring now to FIG. 5, to accommodate still additional braids, a matrix of rings 14 is joined by cooperating pins and holes at locations ninety degrees displaced from one another. Thus, any interior ring 14A has an associated connected ring 14 not only at the six and twelve o'clock positions, in the manner of the linear series arrangement of FIG. 2, but also at the three and nine o'clock positions. Thus, each interior ring 14A is connected to four other rings 14 at four points spaced apart along the interior ring 14A. Many braids of hair can now be styled similarly, and parallel to one another.

Figure 6:
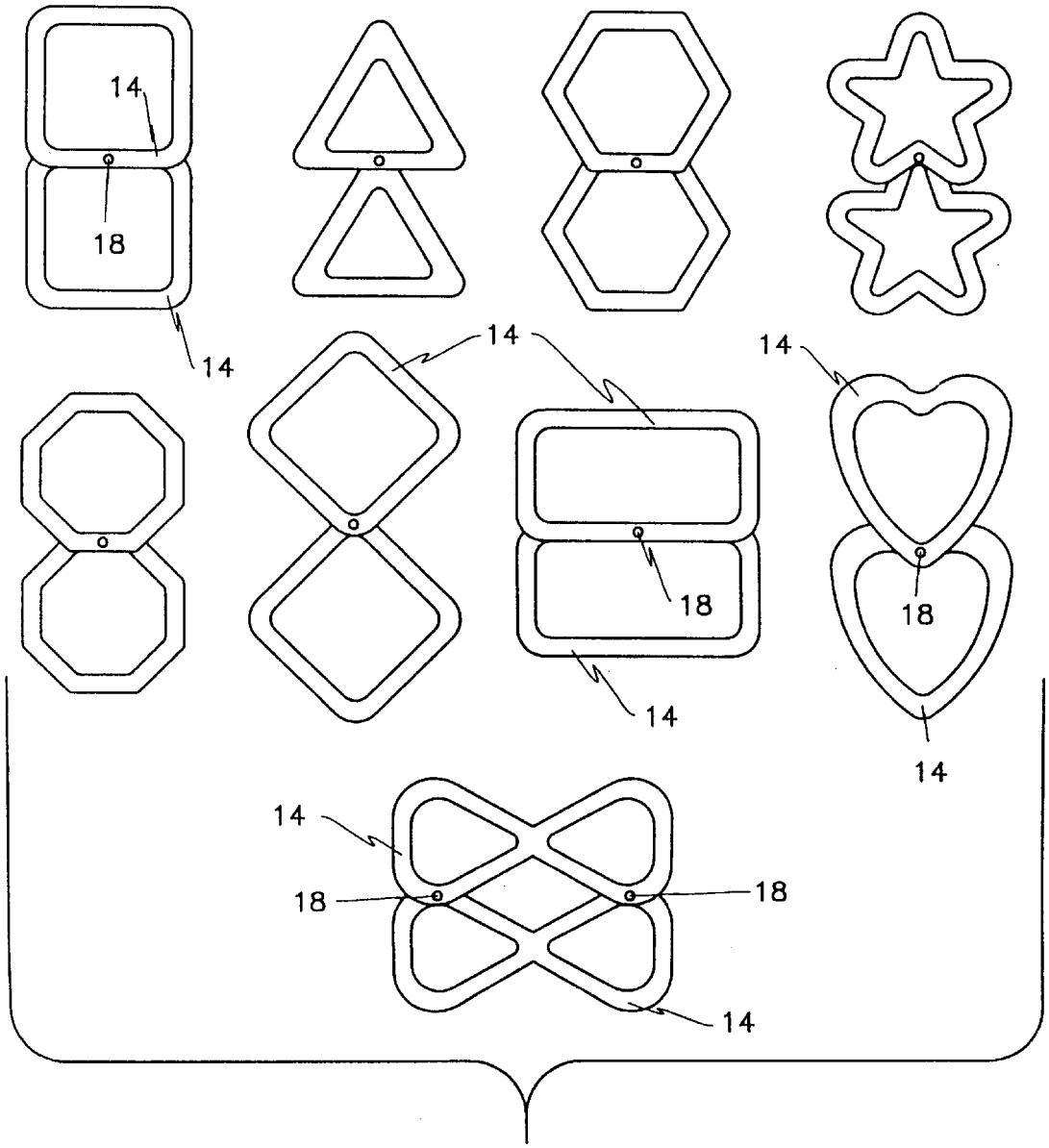
FIG. 6 is a top plan view of alternative forms of rings, wherein the ring is not circular.

Obviously, the invention lends itself to many variations. For example, rigid adherence to right angles of a linking member 18 to its associated ring 14, and an associated hole 16 within its associated ring 14, may be modified. Similarly, a strict arrangement of parallel planes of individual rings 14 may be relaxed. And again, as shown in FIG. 6, rings 14 may be modified to form ovals, squares, triangles, hexagons, octagons, diamonds, and rectangles, among other geometric figures. Irregular shapes may also be employed, such as hearts, bows, and stars. For the purposes of communication, then, the term ring will be understood to encompass any shape forming a closed loop, whereby a hair braid is positively entrapped therein after being passed through the ring.

In addition, elements of various embodiments may be mixed. Different shaped rings may be combined in one hair styling device. The type of linking member may be varied within one hair styling device.

In a preferred method of use, hair is gathered at the back of the head, and passed through the first ring 14. The hair is then divided into two braids 12, preferably of equal bulk. The right side braid 12 is passed through the next ring 14 on the right side, and the left side braid 12 is passed through the same next ring 14 on the left side. The two braids 12 are segregated by linking member 18. The braids 12 are then combined to pass through the third ring 14 in series. This process is repeated until the last ring 14 has been employed.

A new braiding style is thus created in which singular rings alternately divide and combine separate braids 12. The mixing or combining of braids 12 is shown at the first and third rings 14 of FIG. 1.

It is to be understood that the present invention is not limited to the embodiments described above, but encompasses any and all embodiments within the scope of the following claims.

We claim:

1. A hair holding device for hair extending in a plurality of elongated multiple strand hanks of hair which device comprises a plurality of hoops having rim sections which encompass areas each sufficient to receive all of said plurality of hanks, said hoops being arranged successively and being spaced from each other except for areas of the rim portions of successive ones thereof which face each other, said hoops being connected to each other to define a unitary structure having segments between said successive hoops where said loops are connected, so as to define successive hoops and segments through which said plurality of hanks are laced, all of said hanks through said hoops and individual ones of said hanks around said segments.

2. The device according to claim 1, wherein said segments are defined at least in part by portions of successive ones of said rings which overlap, said hoops being connected where they overlap.

3. The device according to claim 2, wherein said overlapping segments comprise attachments extending between said overlapping portions.

4. The device according to claim 1, wherein said hoops have sufficient cross section to be rigid and said segments are also rigid so that said unitary structure is rigid.

* * * * *